US007052193B2

(12) United States Patent
Kobayashi et al.

(10) Patent No.: US 7,052,193 B2
(45) Date of Patent: May 30, 2006

(54) SCRATCH CARD PRINTER AND METHOD OF PRINTING INFORMATION ON A SCRATCH CARD

(75) Inventors: Yozo Kobayashi, Fuji (JP); Toshiyuki Tamura, Mishima (JP); Takayuki Hiyoshi, Sunto-gun (JP)

(73) Assignee: Toshiba Tec Kabushiki Kaisha (JP)

( * ) Notice: Subject to any disclaimer, the term of this patent is extended or adjusted under 35 U.S.C. 154(b) by 0 days.

(21) Appl. No.: 10/911,779

(22) Filed: Aug. 4, 2004

(65) Prior Publication Data

US 2005/0031394 A1 Feb. 10, 2005

(30) Foreign Application Priority Data

Aug. 8, 2003 (JP) ..... 2003-290243
Aug. 8, 2003 (JP) ..... 2003-290244

(51) Int. Cl.
*B41J 2/30* (2006.01)
*B42D 15/00* (2006.01)

(52) U.S. Cl. ..... 400/120.02; 283/94

(58) Field of Classification Search ..... 400/120.02; 283/94, 102, 74

See application file for complete search history.

(56) References Cited

U.S. PATENT DOCUMENTS 4,643,454 A * 2/1987 Ondis ..... 283/74
4,850,618 A * 7/1989 Halladay, Jr. ..... 283/94
5,704,647 A * 1/1998 Desbiens ..... 283/67
6,729,656 B1 * 5/2004 Kubert et al. ..... 283/100

FOREIGN PATENT DOCUMENTS

| | | |
|---|---|---|
| GB | 2 311 040 | 3/1997 |
| JP | 10 337911 | 12/1998 |
| JP | 11 198554 | 7/1999 |
| JP | 2001-113889 | 10/1999 |
| JP | 2002 254688 | 9/2002 |
| JP | 2002 254833 | 11/2002 |
| WO | WO 95/14579 | 11/1994 |

OTHER PUBLICATIONS

Communication from European Patent Office re: counterpart application.

* cited by examiner

*Primary Examiner*—Andrew H. Hirshfield
*Assistant Examiner*—Wasseem H. Hamdan
(74) *Attorney, Agent, or Firm*—Harness, Dickey & Pierce, P.L.C.

(57) ABSTRACT

A scratch card printer has a conveying section to convey a card, for example, by a plurality of conveying roller pairs, a first printing mechanism to have a thermal head, printing control means to control a printing head of the first printing mechanism to allow information, to be printed on a card, a second printing mechanism configured to have a thermal head located more on a downstream side in a direction of conveying of the card by the conveying section than the first printing mechanism, and a thermal transfer control section which, in order to cover the information printed by the first printing mechanism, controls the thermal head of the second printing mechanism to allow an ink to be transferred to the card from a thermal transfer ribbon for concealment.

5 Claims, 8 Drawing Sheets

SCRATCH CARD PRINTER AND METHOD OF PRINTING INFORMATION ON A SCRATCH CARD

CROSS-REFERENCE TO RELATED APPLICATIONS

This application is based upon and claims the benefit of priority from prior Japanese Patent Applications No. 2003-290243, filed Aug. 8, 2003; and No. 2003-290244, filed Aug. 8, 2003, the entire contents of both of which are incorporated herein by reference.

BACKGROUND OF THE INVENTION

1. Field of the Invention

The present invention relates to a scratch card printer for preparing a scratch card with printed information, such as a character or image, covered for concealment in which the concealed character or image can be visualized by scratching the covered material off the card surface by a nail, a coin, etc.

2. Description of the Related Art

Conventionally, the main printing method of a scratch card for use in the private lottery, etc., is by a printing machine. In this printing system, a form plate corresponding to a character, an image, etc., is initially prepared so as to initially print it on cards. With the use of such a form plate, card printing is effected in large quantities. In a printing machine where an ink for concealment is set, printing is made on cards in a manner to cover the printed character, an image, etc., with a concealing material. In this way, scratch cards have been produced in large quantities. In this case, separate printing methods are used one for effecting printing based on the form plate by which a character, an image, etc., are printed on cards and one for effecting printing with such character, image, etc., covered with a concealing material. This separating method is suited to mass production of scratch cards one at a time.

Another printing method is also considered by which printing is effected with a generally known thermal printer to obtain scratch cards. In this printing system, for example, a character, an image, etc., are printed on a card by heating an ink ribbon or underlying heat-sensitive sheet by means of a thermal head. After the thermal head has been set to a condition under which printing is made by the thermal head with the thermal ribbon for concealment, printing is done so as to conceal the character, an image, etc., with a cover material. In this connection it is to be noted that, after such concealing printing, the operator has to reset the thermal head back to an original position.

The thermal transfer ribbon for covering the printed character, the image, etc., on the card for concealment has been known, some having a matte layer and heat-melting ink layer on a film base material and some having a heat-resisting layer on the other surface of such a film base material so as to prevent any adverse effect from a sticking due to a heat from the thermal head as well as from a wrinkle upon making of printing (for example, JPN PAT APPLN KOKAI PUBLICATION No. 2001-113889).

For such separate printing methods in which one printing is made on a card based on a form plate corresponding to a character and image and another printing is made in a manner to cover such a character and image, etc., with a concealing material, it is appropriate to make printing on cards in large quantities. In this separate method, it is necessary to prepare many plate forms corresponding to many kinds of characters and images. Further, there is the case where only a small number of cards are required for respective kinds of them and, even if many scratch cards are prepared, more are left in stock, so that these methods are not appropriate. Since, in the latter printing method, the operator has to change the settings of printing a plurality of times, these operations become very cumbersome. Where two printers are used one to print the character, image, etc., on the cards and one to make concealing printing in a manner to cover the character, image, etc., for concealment, more installation space is required and added costs are involved.

Though the character, image, etc., are printed on the cards, no correct printing control corresponding to the characteristic of the thermal transfer ribbon for concealment is done upon the making of concealing printing to cover the character, image, etc. That is, when solid printing is done while heating the thermal transfer ribbon for concealment, printing control is done with an equal energy upon the making of solid printing on a printing area of the card. Since, however, a metal material is contained in an ink layer of the thermal transfer ribbon, a viscosity curve becomes gentler with respect to the temperature. If printing is done under the above-mentioned printing control, no sharp edge is obtained at the final end edge portion of an printing area and there occur bleeding, blurring, reverse transfer, etc., so that a printing quality thus obtained becomes deteriorated.

BRIEF SUMMARY OF THE INVENTION

The present invention is achieved with the above in view and the object of the present invention is to provide a scratch card printer which is suited to the production of many kinds of scratch cards in smaller numbers and can be installed in less space at lower costs.

In an aspect of the present invention there is provided a scratch card printer comprising conveying means configured to convey a card, for example, by a plurality of conveying roller pairs, a first printing mechanism configured to have a printing head such as a thermal head, printing control means configured to control the printing head of the first printing mechanism to print information, such as a character or image, on a card, a second printing mechanism configured to have a thermal head located more on a downstream side in the conveying direction of the card by the conveying means than the first printing mechanism, and thermal transfer control means which, in order to cover the information, such as the character and image, printed on the card by the first printing mechanism, controls the thermal head of the second printing mechanism to allow an ink to be transferred from the thermal transfer ribbon for concealment.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
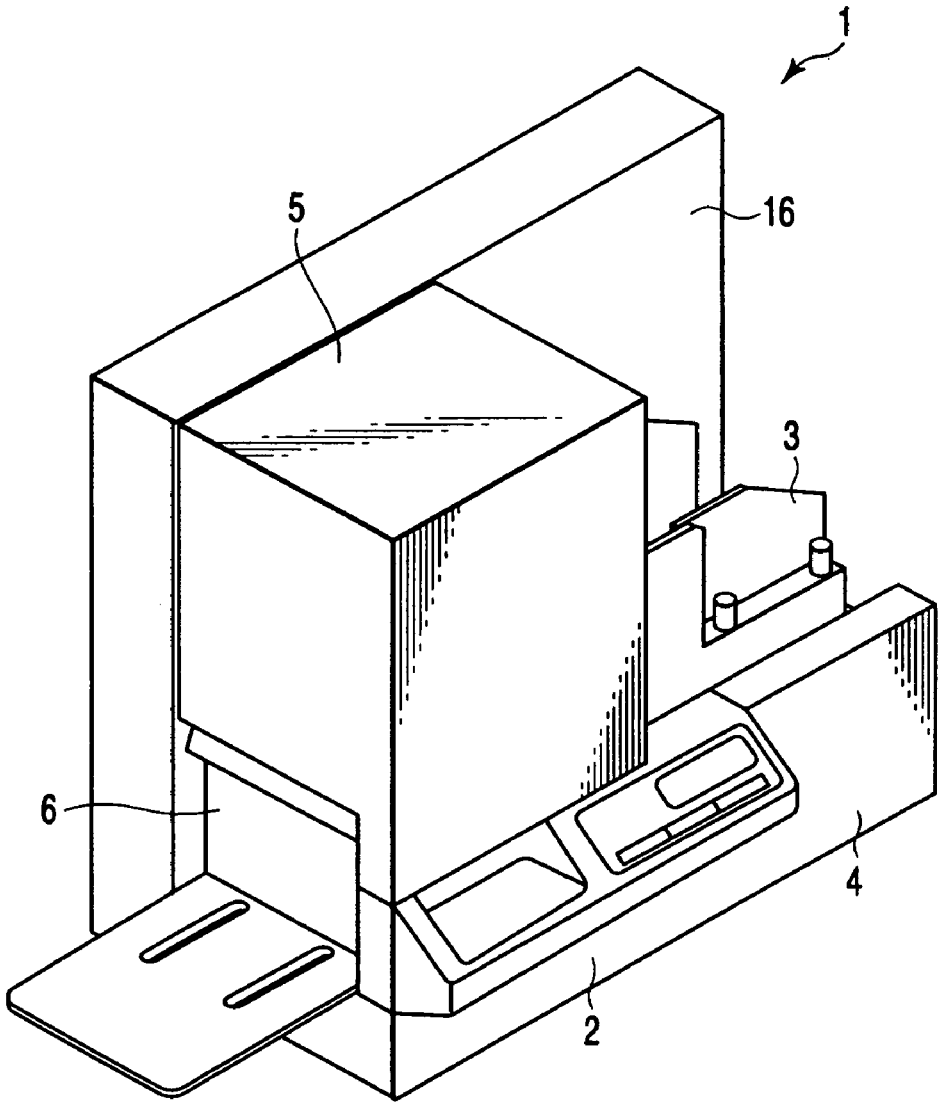
FIG. 1 is a perspective view showing an outer appearance of a scratch card printer according to first and second embodiments of the present invention.

With reference to the drawing, an explanation will be made in more detail below about a first embodiment of the preset invention.

Figure 2:
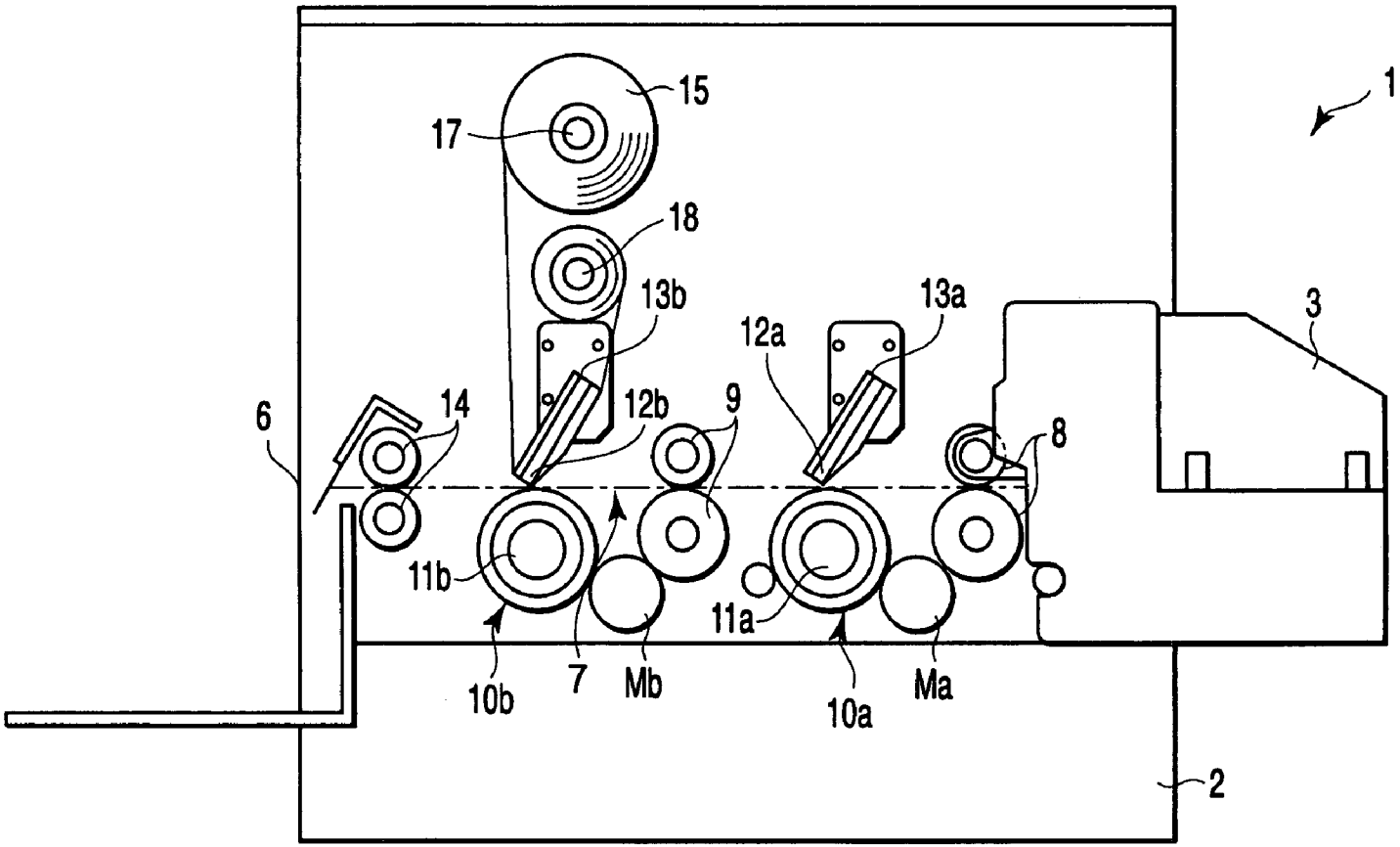
FIG. 2 is a view in vertical cross-section diagrammatically showing an inner arrangement of the scratch card printer according to the first and second embodiments of the present invention.
Figure 3:
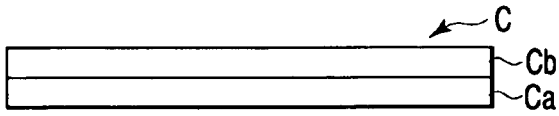
FIG. 3 is a view for explaining the cross-section of a card in the first and second embodiments of the present invention.

FIG. 1 is an outer perspective view showing a scratch card printer 1 and FIG. 2 is a vertical, lateral cross-sectional view diagrammatically showing a structure of the scratch card printer 1. As shown in FIG. 1, the scratch card printer 1 comprises a printer body 2 and a sheet supply device 3 detachably mounted on the printer body 2. The sheet supply device 3 has cards C held therein. In this embodiment, the card C held in the sheet supply device 3 has a base material as an underlying heat-sensitive sheet so as to make a printing cost lower. FIG. 3 is a cross-sectional view showing the card C. In the cross-section of the card C, a heat-sensitive sheet color-developing layer Cb is provided on the heat-sensitive sheet base material Ca. the color-developing layer Cb is color-developed when a heat of a predetermined temperature is applied. The card C is supplied by the sheet supply device 3 into the printer body 2 where printing is made. Covers 4 and 5 are provided on the printer body 2. The cover 5 is detachably mounted on the cover 4. In the state in which the cover 5 is mounted on the cover 4, a card issuing outlet 6 is provided in front of the printer body 2.

As shown in FIG. 2, a card conveying path 7 leading to the card issuing outlet 6 from the sheet supply device 3 is provided within the printer body 2 and, after the card which is held by a pair of rotatably conveying rollers 8 on the card conveying path 7 is drawn from the sheet supply device 3 onto the sheet conveying path 7, the card is passed over to a pair of rotatable conveying rollers 9 on the card conveying path and so guided as to allow it to be delivered from the card issuing outlet 6 by a pair of conveying rollers 9 near the card issuing outlet 6. Thus, conveying means is provided by the conveying roller pairs 8, 9 and 14.

In the card conveying path 7 for guiding the card, first and second printing mechanisms are provided as first and second printing mechanisms 10*a* and 10*b*, respectively. The printing mechanism 10 (10*a*, 10*b*) is mainly comprised of a platen roller 11 (11*a*, 11*b*) rotatably driven by a stepping motor M (Ma, Mb) and a thermal head 12 (12*a*, 12*b*), having many heat generating elements arranged as a line array, which is in contact with the platen roller 11 (11*a*, 11*b*) through the card conveying path 7. The thermal head 12 (12*a*, 12*b*) is retained on a head retaining plate 13 (13*a*, 13*b*). The head retaining plate 13 (13*a*, 13*b*) is such that the thermal head 12 (12*a*, 12*b*) is urged, by a spring not shown, toward the platen roller 11 (11*a*, 11*b*). As a result, the card which is held between the thermal head 12 and the platen roller 11 is guided on the card conveying path 7 by the rotation of the platen roller 11 and, therefore, the thermal head 12 and platen roller 11 constitute conveying means also.

Between the thermal head 12*a* and the platen roller 11*a*, the card C is conveyed with its color-developing layer upside and, by being selectively heated by the heat generating elements of the thermal head 12*a*, has its color-developing layer Cb thermally sensitized to allow character information to be printed thereon. The character information is comprised of, for example, a character, an image and a combination of these and, if the scratch card is used, for example, for a lottery ticket, shows the character indicating a "1st-prize", a "2nd-prize" and "no points".

Further, between the thermal head 12*b* and the platen roller 11*b*, a thermal transfer ribbon for concealment is located and, by selectively heating the heat generating elements of the thermal head 12*b*, an ink of the heat transfer ribbon 15 for concealment is melted or sublimed to allow it to be printed on the card. An available thermal transfer ribbon 15 for concealment is wound on a supply shaft 17 having its one end retained on a frame 16.

The used thermal transfer ribbon 15 is wound on a take-up shaft 18 having its one end supported on the frame 16. The take-up shaft 18 is rotationally driven by a driving force transmitted by a gear train from a stepping motor Mb.

Figure 4:
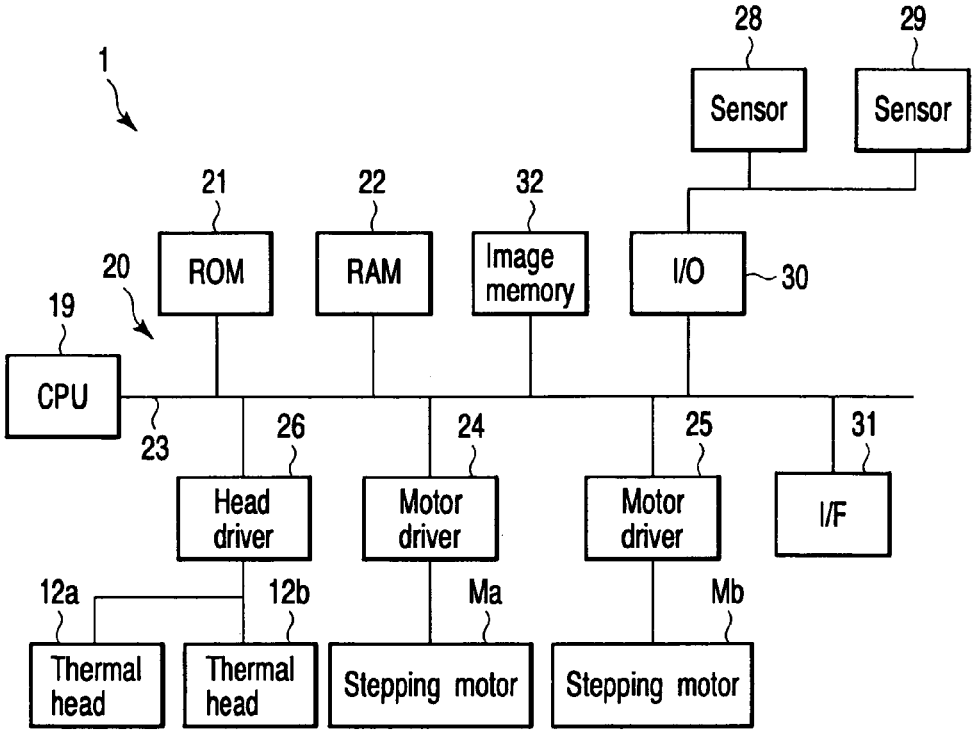
FIG. 4 is a view showing an electrical connection relation of the scratch card printer in the first and second embodiments of the present invention.

FIG. 4 is a view showing an electrical connection relation of each part built in the scratch card printer 1. For example, the stepping motor Ma for rotationally driving the platen roller 11*a*, etc., the stepping motor Mb for rotationally driving the platen roller 11*b*, etc., the thermal head 12 (12*a*, 12*b*), etc., are drive-controlled by a microcomputer 20 comprised of a CPU (central processing unit) 19, etc. That is, the CPU 19 is such that it performs various computing operations and centrally controls the various parts. A ROM (read only memory) 21 for fixedly storing fixed data, a RAM (random access memory) for storing variable data in a freely writable fashion are connected to the CPU 19 through a system bus 23. A control program is stored in the ROM 21. The microcomputer 20, while utilizing the RAM 22 as a work area, performs various kinds of processing in accordance with a control program stored in the ROM.

According to the present embodiment, as respective parts drive-controlled by the microcomputer 20 so as to perform the printing operation of the printing mechanism 10 (10*a*, 10*b*), there are provided a motor driver 24 for drive-controlling the stepping motor Ma for rotationally driving the platen roller 11*a*, etc., a motor driver 25 for drive-controlling the stepping motor Mb for rotationally driving the platen roller 11*b*, etc., and a head driver 26 serving as a drive control circuit for drive-controlling the thermal head 12 (12*a*, 12*b*). These motor drivers 24, 25 and head driver 26 are connected to the CPU 19 through the system bus 23. It is to be noted that the head driver 26 of the present invention serves as a circuit capable of separately drive-controlling these two thermal heads 12*a*, 12*b*.

Further, the scratch card printer 1, adopting a line type printing system, allows printing to be done in a main scanning direction by many numbers of heat generating elements 27, in a line-like array, of the thermal head 12 and printing to be done in a sub-scanning direction by the movement of the card C produced by the conveying of the card C relative to the thermal head 12. In order to effect printing in the sub-scanning direction it is necessary to control the convey-timing, etc., of the card C and a sensor 28 for detecting the position of the card C is located at the card conveying path 7. Further, a sensor 29 is also located within a housing of the scratch card printer 1 and serves as a temperature detecting means for detecting, as ambient temperature, a temperature within a room where the scratch card printer 1 is located. These sensors 28, 29 are connected to the system bus 23 through an I/O port 30.

In the scratch card printer 1, for example, printing information which is transferred from an outer device such as a computer device is taken through the interface 31 and it is converted to image information and developed in an image memory 32. The interface 31 and image memory 32 are also connected through the system bus 23 to the CPU 19.

Figure 5:
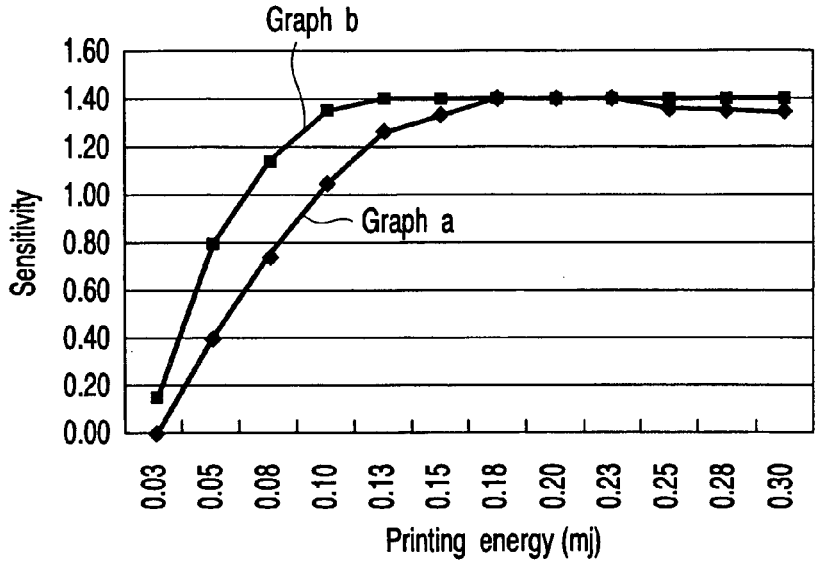
FIG. 5 is a graph showing a relation of the printing energies of the two heads in the first embodiment of the present invention.

FIG. 5 is a graph showing a relation between the printing energy supplied to the thermal head 12 (12*a*, 12*b*) and the optical sensitivity characteristic of the printing section of the card C and its concealed material by the thermal transfer ribbon for concealment. In FIG. 5, the optical sensitivity of the printing section and concealed section of the card C was measured at 25° C., while applying the printing energy (mj: millijoules) to the thermal heads (12*a*, 12*b*), by measuring the OD (optical density) values by means of the Macbeth illuminometer. The graph a shows a relation between the printing energy supplied to the thermal head 12*a* and the sensitivity to the printed section of the card C while, on the other hand, the graph b a relation between the printing energy supplied to the thermal head 12*b* and the sensitivity to the concealed section of the card C.

In the scratch card printer 1 of this embodiment, at a temperature of 25° C., the printing energy of the thermal head 12*a* for printing the character information on the card C and printing energy of the thermal head 12*b* for making printing for concealing the printed character information of the card C are so set to the microcomputer 20 as to be 0.18 mj and 0.13 mj, respectively (setting means). If, as indicated by a graph a in FIG. 5, printing is made by the thermal head 12*a* with the printing energy of 0.18 mj and, as indicated by a graph b in FIG. 5, printing is made by the thermal head 12*b* with the printing energy of 0.13 mj, then the sensitivity of the printing section and concealed section of the card becomes 1.40 and it is possible to make better printing.

By setting the printing energy of the above-mentioned thermal head 12*b* smaller than that of the thermal head 12*a*, it is possible to prevent a drop in printing quality which might be caused due to the card being again color-developed in the case where, after the printing of the character information by the thermal head 12*a*, printing is made by the thermal head 12*b* for concealing the printed information.

Figure 6:
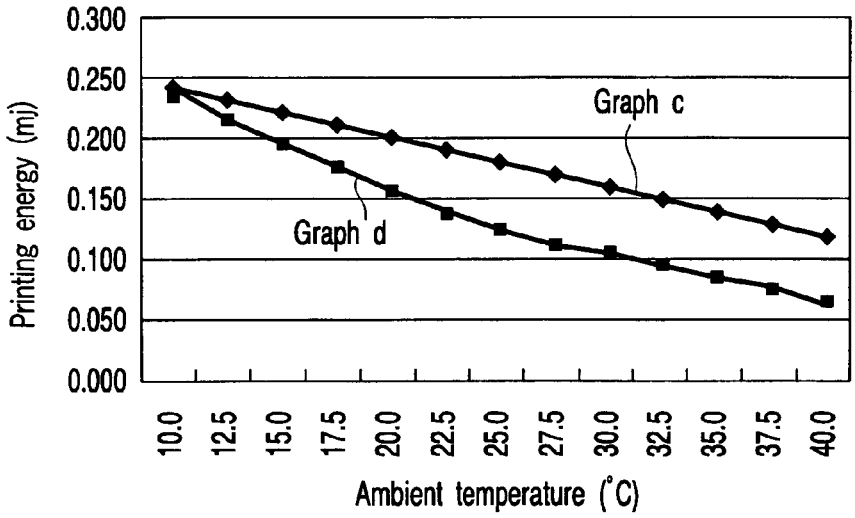
FIG. 6 is a graph showing a relation between the temperature and the energy supplied to the two heads in the first embodiment of the present invention.

FIG. 6 is a view showing a relation between the ambient temperature indicated by room temperature and the printing energy of the thermal head 12 (12*a*, 12*b*). In FIG. 6, a graph c shows a relation between the ambient temperature and the printing energy supplied to the thermal head 12*a*, while, on the other hand, a graph d a relation between the ambiet temperature and the thermal energy supplied to the thermal head 12*b*. As indicated by the graphs c and d, as the ambient temperature rises from 10° C. to 40° C., it is possible to make printing by the thermal head 12 (12*a*, 12*b*) with a smaller corresponding printing energy.

In the scratch card printer 1 of this embodiment, the data showing a relation between the ambient temperature and the printing energy of the thermal head 12 (12*a*, 12*b*) as shown in FIG. 6 is set to the ROM 21. Based on the temperature detected by the temperature detecting sensor 29 and data stored in the ROM 21, the CPU 19 controls the head driver 26 to allow the printing energies of the thermal heads 12*a* and 12*b* to be separately controlled (energy controlling means). Further, as shown in FIG. 6, the graph c showing the relation between the thermal head 12*a* and the ambient temperature is so set as to have a gentle slope while, on the other hand, the graph d showing a relation between the thermal head 12*b* and the ambient temperature is so set as to have a greater slope than that of the graph c. Thus, the printing energy of the thermal head 12*b* is so set as to be always smaller than that of the thermal head 12*a*. In this way, even if the ambient temperature varies from 10° C. to 40° C., printing can be made at all times by the thermal head 12 (12*a*, 12*b*) to a varied temperature with an optimal printing energy. It is also possible to prevent a drop in printing quality which might be caused due to the card being again color-developed in the case where, after the printing of the character information by the thermal head 12*a*, printing is effected by the thermal head 12*b* for concealing the character information.

Now an explanation will be made below about effecting printing by the scratch card printer 1 thus structured.

First, the operation sets a predetermined number of cards C in the sheet supply device 3, the card being printed with a background design while setting a heat-sensitive area upside to allow printing information to be thermally printed. For example, the card C has six heat-sensitive areas for allowing two "6th-prize" and four "no points" to be thermally printed. With the use of, for example, a computer device connected through the I/F 31, the operator prepares printing information including character information for thermally printing the 6th-prize and no points on the six heat-sensitive areas, concealing position information for designating a concealed section for concealing the character information printed on the six heat-sensitive areas, information relating to the number of cards to be printed, and so on, and transmits the printing information to the scratch card printer 1 through the I/F 31. Although, in the present embodiment, the printing information is received from the computer device through the I/F 31, an operating/displaying section may be provided on the scratch card printer 1, so that, upon receipt of an operation from the operation/displaying section by the operator, the printing information is prepared on the scratch card printer.

Figure 7:
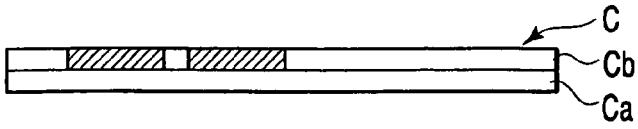
FIG. 7 is a cross-sectional view showing a card when character information is thermally printed in the first embodiment of the present invention.
Figure 8:
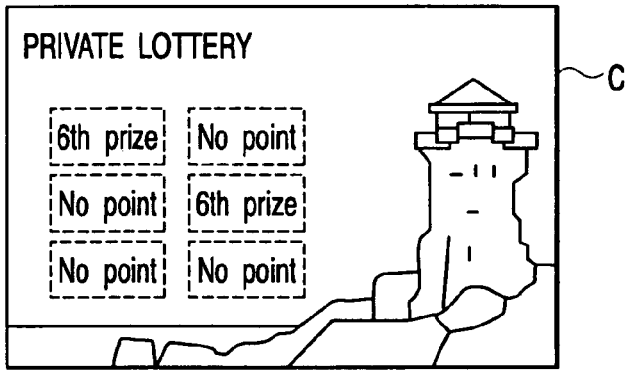
FIG. 8 is a plan view showing a card on which the character information is printed in the first embodiment.

When the scratch card printer 1 receives the printing information through the I/F 31, one card is drawn by the sheet supply device 3 onto the card conveying path 7 and conveyed into a nip between the thermal head 12*a* and the platen roller 11*a* in the printing mechanism 10*a*. At this time, the heat generating elements of the thermal head 12*a* are selectively heat-generated based on the character information to allow the heat-sensitive color-developing layer Cb of the card C to be color-developed and the character information to be thermally printed on the card (printing control means). The printing energy involved upon the making of printing by the thermal head 12*a* is based on the printing energy corresponding to the temperature detected by the temperature detecting sensor 29. FIGS. 7 and 8 show one example of the card C printed based on the character information. FIG. 7 shows a cross-sectional view of the card C on which the character information is thermally printed, while, on the other hand, FIG. 8 shows the above-mentioned heat-sensitive areas defined by six areas indicated by the broken line.

Figure 9:
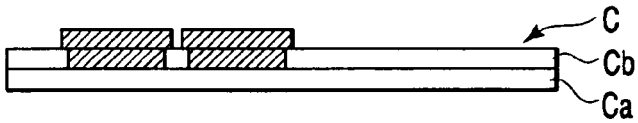
FIG. 9 is a cross-sectional view showing a card when a thermal printing ribbon is printed in the first embodiment.
Figure 10:
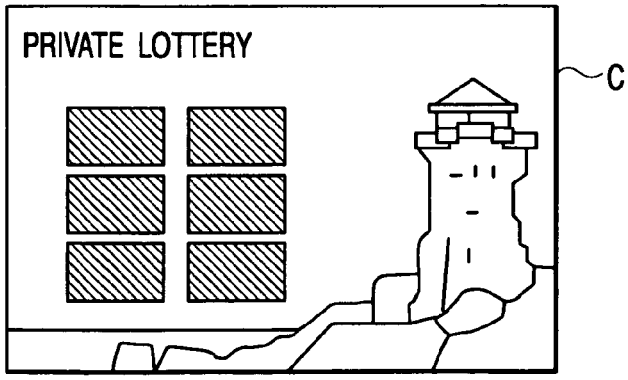
FIG. 10 is a plan view showing a scratch card to which the thermal transfer ribbon is transferred in the first embodiment.

The card C with the character information printed therein is conveyed on the card conveying path 7 and sent to a nip between the thermal head 12*b* and the platen roller 11*b* in the printing mechanism 10*b*. At this time, the heat generating elements of the thermal head 12*b* are selectively heat-generated based on the concealing position information to allow the thermal transfer ribbon 15 for concealment which is interposed between the thermal head 12*b* and the platen roller 11*b* to be melted and allow an ink from the thermal transfer ribbon 15 to be transferred to the card C (thermal transfer control means). The printing energy involved upon the making of printing by the thermal head 12*b* is based on the printing energy corresponding to the temperature detected by the temperature detecting sensor 29. Further, the printing energy of the thermal head 12*b* is made smaller than that of the thermal head 12*a*. FIGS. 9 and 10 show one example of a card C in which, with the thermal transfer ribbon 15 for concealment, printing is made based on the concealing position information. FIG. 9 is a cross-sectional view showing the card C in which the character information printed section is concealed, while, on the other hand, FIG. 10 shows a printed surface of the card C where printing is made with the thermal transfer ribbon for concealment.

When the printing of one card C has been finished, the next card which is set on the sheet supply device 3 starts its printing. In this way, based on the sheet number information set by the operator, cards C are taken one by one from the sheet supply device 3 so as to effect sequential printing. That is, onto the background-printed card C set to the sheet supply device 3 by the operator, character information set by the operator on the computer device is printed by the scratch card printer 1. Thus, the character information such as a character and image is thermally printed to a card position desired by the operator and the scratch cards concealed on their heat-sensitive printing area with a concealing material by the thermal transfer ribbon can be easily prepared in any numbers desired by the operator.

According to the scratch card printer 1 of this embodiment, two printing mechanisms 10*a*, 10*b* are provided and cards C set in the sheet supply device 3 are taken out one by one, printing information is printed by the printing mechanism 10*a* and printing is made by the printing mechanism 10*b* to conceal the character information with the thermal transfer ribbon and, by doing so, it is possible to easily prepare a scratch card. Since, therefore, it is not necessary to separately prepare a printer for character information printing and a printer for concealing the character information, it is possible to install the printer in a smaller space at a lower cost. Further, the operator can print any desired character information and prepare the character information-concealed scratch card in any desired numbers. It is, therefore, possible to provide a scratch card printer suitable to the production of many kinds of scratch cards in small numbers.

Further, the printing mechanism 10*a* prints the card C by a thermal printing with a thermal head 12*a* and, in comparison with the printing energy for thermally printing the character information on the card C by the thermal head 12*a* of the printing mechanism 10*a*, the printing energy for effecting printing by means of the thermal head 12*b* of the printing head 10*b* to conceal the character information on the card C is made smaller at all times. By doing so, it is possible to prevent a drop in printing quality which might otherwise be caused due to the card C being gain color-developed. It is thus possible to prepare a scratch card of better printing quality.

Based on the data stored in the ROM 21 and temperature detected by the temperature detecting sensor 29, the CPU 19 separately controls the printing energy for thermally printing the character information on the card C by the thermal head 12*a* of the printing mechanism 12*a* and the printing energy for transferring the ink onto the card C so as to conceal the character information thermally printed on the card C by the thermal head 12*b* of the printing mechanism 10*b*, so that printing can be made at all times with an optimal printing energy to a varying ambient temperature.

Although, in the above-mentioned embodiment, the thermal printing has been explained as being made by the thermal head (printing mechanism 10*a*) with the base material of the card as an underlying heat-sensitive sheet, the present invention is not restricted thereto. Another structure may be used in which, for example, an ink ribbon for printing the character information is located between the thermal head 12*a* and the platen roller 11*a* and one end of the ink ribbon is supported on the frame 16 and retained on the supply shaft and the ink ribbon is wound by the take-up shaft. In this way, printing is made with the ink ribbon. Since, though being dependent upon the kinds of ink ribbons, printed character information using some ink ribbon is hard to erase when its concealing cover is scratched off the card surface, this structure is effective when using such a ribbon.

With reference to FIGS. 1 to 4 and 11 to 17, an explanation will be made below about a second embodiment of the present invention. Since the structure of FIGS. 1 to 4 has already been explained, any detailed explanation of it is omitted here.

Figure 11:
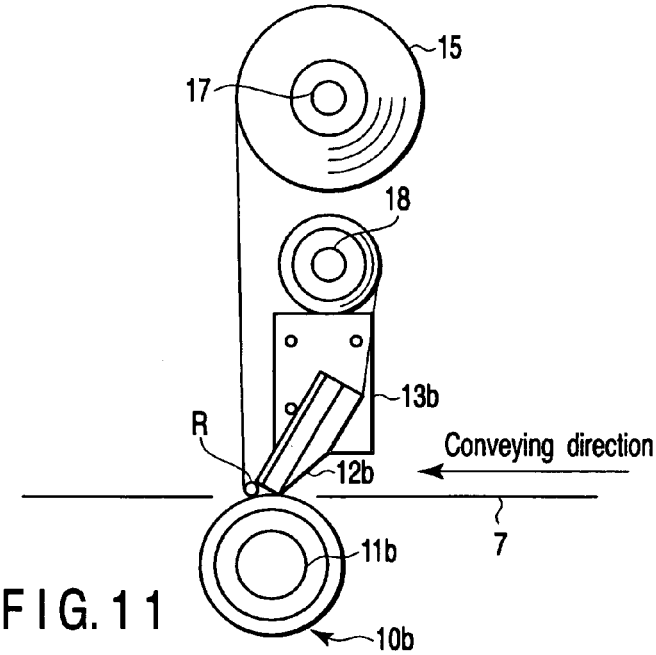
FIG. 11 is an enlarged view showing a second printing mechanism in the second embodiment of the present invention.

As shown in FIG. 11, a thermal transfer ribbon 15 for concealment is located between a thermal head 12*b* and a platen roller 11*b*. By selectively heating these heat-sensitive elements of the thermal head 12*b*, an ink of the thermal transfer ribbon 15 is melted or sublimed to allow printing to be made on a card C. An available thermal transfer ribbon 15 for concealment is retained on a supply shaft 17 having one end supported on the frame 16. And the used thermal transfer ribbon portion is wound around a take-up shaft 18 having one end supported on the frame 16. The take-up shaft 18 is rotationally driven by a drive force transmitted from a stepping motor Mb through a gear train. A separating guide roller R is provided a predetermined distance on a downstream side from a location where the above-mentioned thermal head 12*b* is pushed against the platen roller 11*b*, so that a timing for separating the thermal transfer ribbon 15 for concealment from the card C is delayed (separating means). The delaying of the timing is because, after the transferred ink has been set, the thermal transfer ribbon 15 is separated from the card. The location of the separating guide roller R is initially set to be optimal based on the material, etc., of the thermal transfer ribbon 15. Although, in the above-mentioned embodiment, the separation guide roller R is provided, a structure using a shaft instead may also be adopted.

Figure 12:
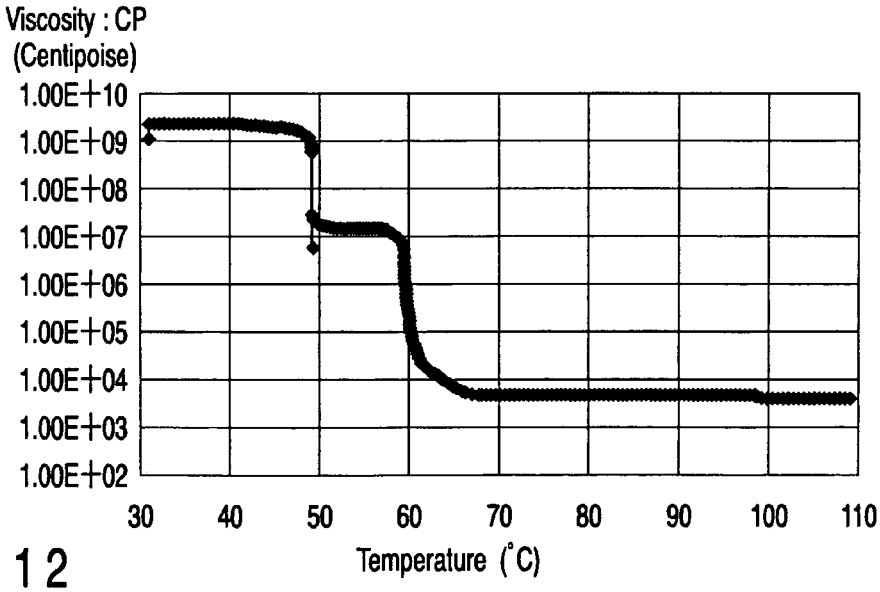
FIG. 12 is a view showing the viscoelastic characteristic of an ink layer material from the thermal transfer ribbon for concealment in the second embodiment.
Figure 13:
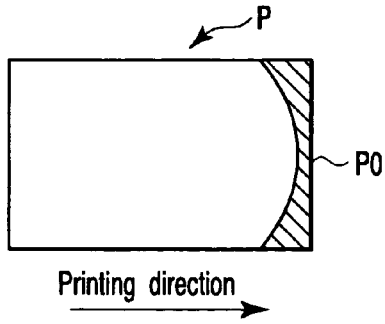
FIG. 13 is a view for explaining a printing area at an ill-defined printing end edge portion in connection with the second embodiment.
Figure 14:
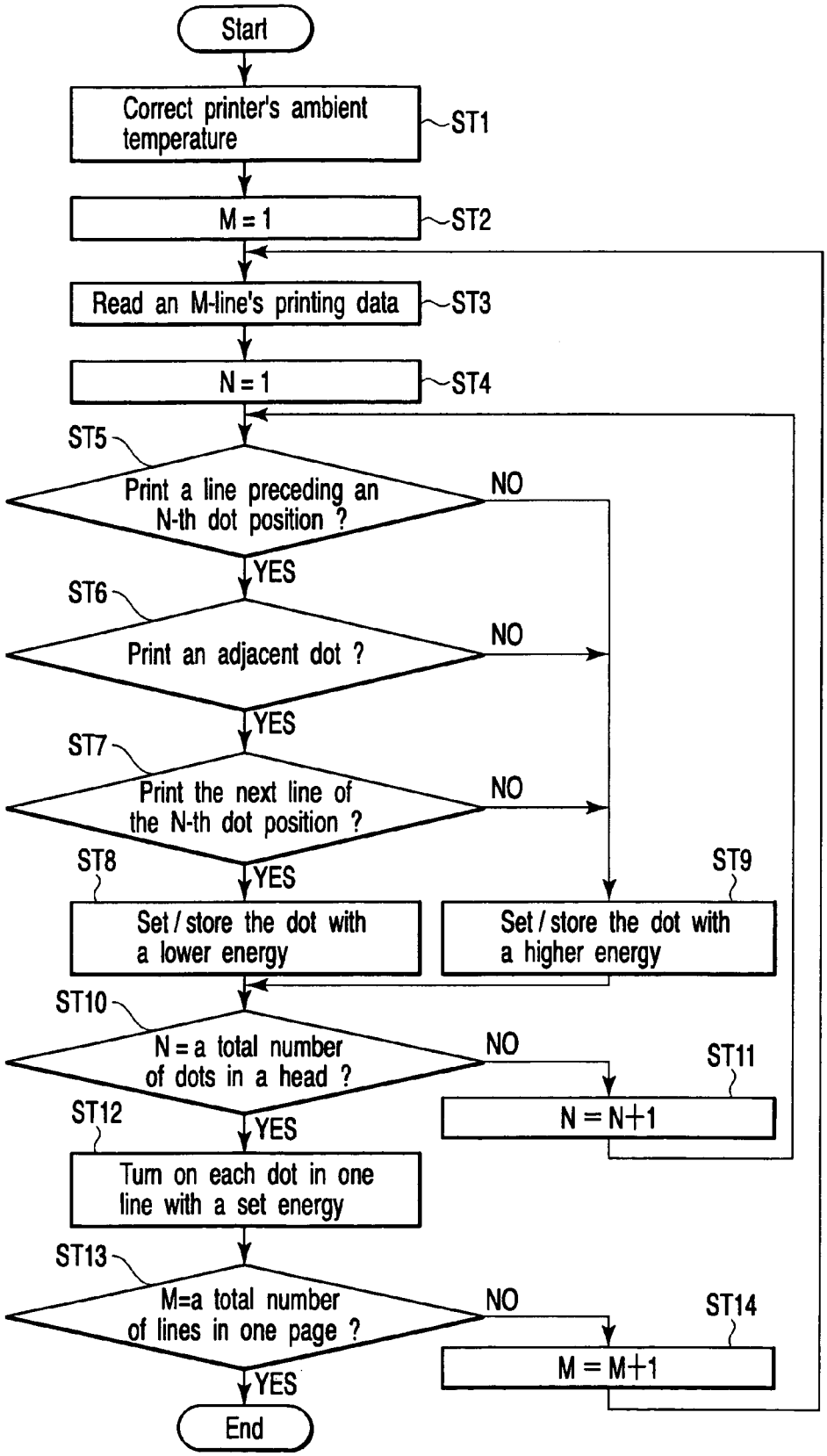
FIG. 14 is a flow chart showing a printing process on the second embodiment.

FIG. 12 is a view showing a relation between the viscosity and the temperature when printing is made with the use of a thermal printing ribbon 15 for concealment, that is, a view showing the viscoelasticity characteristic of a material used for the inking layer of the thermal transfer ribbon 15 for concealment. Since a metal material is contained in the ink layer, as shown in FIG. 12, the viscosity curve shows a gradual characteristic with respect to the temperature. Since the card C has its character information concealed with the material having such viscoelastic characteristic, if any printing is made as solid printing on a whole rectangular area P for example with an equal printing energy, no sharp printed edge will be obtained as shown in FIG. 13. This ill-defined printed edge as indicated by an area P0 occurs, at a printing end of the card C, as a bleeding, a blurring or a reverse transfer.

In order to secure any better printed edge at the printing end area P0, of the card C, the following printing processing is done upon the making of printing by the thermal head 12*b*. Although, in this embodiment, the processing is done by running a control program stored in the ROM 21, another CPU may be provided as a dedicated one for implementing such a control program for the processing or a circuit section for performing such processing may be provided by implementing such circuit.

Upon receipt of the printing information through the interface 31, the processing is started. First, the setting of the printing energy of the thermal head 12*b* is corrected based on the temperature detected by the sensor 29 (ST1). That is, the printing energy suitable to the ambient temperature is set based on the fixed data showing a temperature table stored in the ROM 21. Then, a parameter Ml representing the number of lines in a page is set to 1 (ST2). The received printing information is converted to image information and the data of an M line is read from the image memory 32 (ST3).

When a parameter N showing a dot position is set to 1 (ST4), it is decided whether or not a line preceding the n dot position is printed (ST5), whether or not any adjacent dot is a dot to be printed (ST6) and whether or not the next line of the N dot position is to be printed (ST7).

If all these steps ST5 to ST7 are decided as being YES, the dots involved are so set as to be printed with a lower energy and so stored (ST8). If even one of these decisions at steps ST5 to ST7 is decided as being NO, the dots involved are so set as to be printed with a higher energy and so stored (ST9). It is to be noted that, in this processing, the lower energy represented as the printing energy of the dots when printing is made means the printing energy set at step ST1 and the higher energy means an energy higher by about 15% than the printing energy set at step 1.

Then it is decided whether or not the numeric value stored to the parameter N coincides with a total number of dots of the head. If it is decided that the numeric value stored to the parameter N does not coincide with the total number of dots of the head, 1 is added to the parameter N (ST11) and the process goes back to step ST5. When it is decided that the numeric value stored to the parameter N coincides with the total number of dots of the head, the respective dots in the line set to the parameter M are turned ON with the set energy (ST12). That is, the parameter N is used to decide whether or not the printing energy of all dots of one line in a main scanning direction, that is, a direction in which printing is done by the thermal head 12*b*, is set.

Then, it is decided that the numeric value set to the parameter M coincides with all the lines in one page (ST13). If it is decided that the numeric value set to the parameter M does not coincide with the number of all the lines in one page, 1 is added to the parameter M (step ST14) and the process goes back to step ST3. If it is decided that the numeric value set to the parameter M coincides with the number of all the lines in one page, the process is ended. That is, parameter M is used to decide whether or not the printing line of one page is ended.

Figure 15:
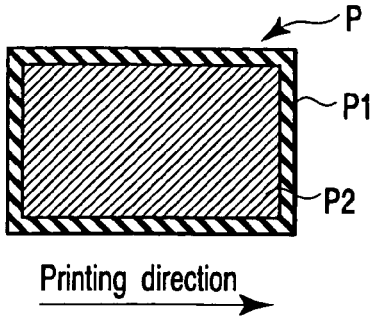
FIG. 15 is a view showing an outer marginal contour portion of a printing area upon the making of solid printing in the second embodiment.

FIG. 15 is a view showing a difference in the printing energy involved at a solid printing area in the case where, in order to conceal character information by the use of the thermal transfer ribbon 15 for concealment, solid printing is done in the printing processing on, for example, a rectangular solid printing area. As shown in FIG. 15, the printing energy of an outer marginal contour portion P1 of a solid printing area P is made greater than that of a remaining inside portion P2 of the solid printing area P.

Now an explanation will be made below about the operation for making a scratch card on the scratch card printer 1 thus structured.

First, the operator sets, in a sheet supply device 3, a predetermined number of cards C having a heat-sensitive area set to allow character information to be thermally sensitized against its background design. This card C has, for example, six heat-sensitive areas where two 6th-prize and four "no points" are allowed to be thermally printed thereon. With the use of, for example, a computer device connected through the I/F 31, the operator prepares printing information containing character information for allowing the "6th-prize" and "no point" characters to be thermally printed on the six heat-sensitive areas, concealing position information for designating those concealing portions for concealing the character information to be printed on the six heat-sensitive areas, and sheet number information, etc., relating to the number of cards to be printed, and transmits the printing information through the I/F 31 to the scratch card printer 1. Although, in this embodiment, the printing information is received from the computer through the I/F 31, the operation/display section may be provided on the scratch card printer 1 in which case the printing information is prepared on the scratch card printer 1 by operating the operation/display section.

When on the printer 1 the printing information is received through the I/F 31, one card is drawn from the sheet supply device 3 onto the card conveying path 7 to allow it to be conveyed between the thermal head 12*a* and the platen roller 11*a* in the printing mechanism 10*a*. At this time, the heat generating elements of the thermal head 12*a* are selectively heated based on the character information and a heat-sensitive sheet color-developing layer Cb is color-developed to allow the card to be thermally printed (printing control means). And printing is done by the thermal head 12*a* with the printing energy corresponding to the thermal energy based on the temperature detecting sensor 29.

The card C having its character information printed thereon is conveyed on the card conveying path 7 and then to a nip between the thermal head 12*b* and the platen roller

11*b* in the printing mechanism 10*b*. At this time, the heat generating elements of the thermal head 12*b* are selectively heated based on the concealing position information and above-mentioned printing processing to allow the thermal transfer ribbon 15 which is located between the thermal head 12*b* and the platen roller 11*b* to be melted and printing to be made on the card C with the thermal transfer ribbon 15 for concealment (thermal transfer printing control means). The printing energy when printing is made by the thermal head 12*b* is such that the printing energy involved at the outer marginal contour portion P1 of the six printing solid areas P is higher than the printing energy involved at a remaining inside area P2 of each of these six printing solid areas P. Further, the separating guide roller R is provided and, without the thermal transfer ribbon being separated from the card C immediately after the thermal transfer ribbon ink has between thermally transferred by the thermal head, it is separated after the card is moved a predetermined position on the downstream side of the card conveying path 7.

After the printing of one card C is thus finished, it is delivered from the card issuing outlet 6 and the printing of the next card C on the sheet supply device 3 is started. In this way, cards C are drawn from the sheet supply device 3 based on the sheet number information set by the operator.

Figure 16A:
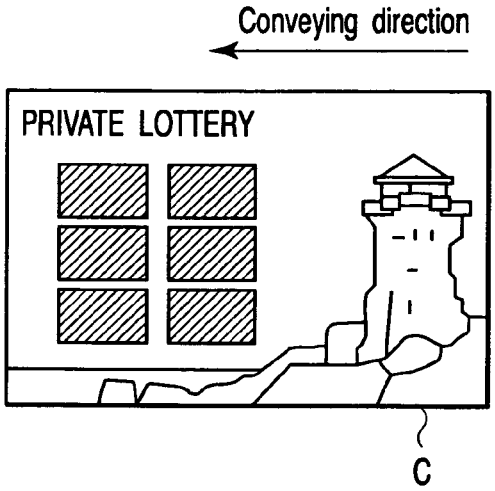
FIGS. 16A and 16B, each, show a scratch card set out in connection with the second embodiment.
Figure 16B:
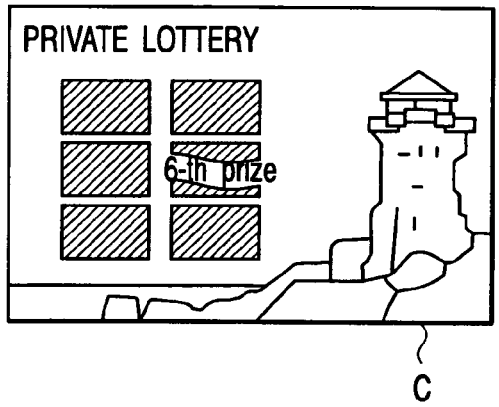

FIG. 16A is a view showing one example of a thus prepared scratch card having six rectangular printing areas P and FIG. 16B is a view showing a state of a scratch card in which, out of the six areas with character information printed thereon, one has its concealed cover scratched off the surface. It is to be noted that the scratch card is prepared by making printing in a printing direction as indicated by an arrow in FIG. 16A. At the right-side portions of the six printed areas P with the character information concealed with a concealing cover on the scratch card, any bleeding, blurring and inverse transfer are not produced.

According to the scratch card printer 1 of the present embodiment, printing is made with the printing mechanism 10*b* by heating the thermal transfer ribbon 15 by those associated heating elements of the thermal head 12*b* and, when such printing is done by making the printing energy at the outer marginal contour portion P1 of the respective printing area P greater than the printing energy at the remaining inside portion P2 of the printing area P, it is possible to prevent occurrence of bleeding, blurring, inverse transfer, etc., at the final printing end edge of the printing area P of the card C and thus to prepare a scratch card of better printing quality.

Further, the separation guide roller R is provided a predetermined distance on the downstream side from a location where the thermal head 12*b* is pressed against the platen roller 11*b* and, by doing so, the timing of separating the thermal transfer ribbon 15 from the card C is delayed. And without the thermal transfer ribbon 15 being separated from the card C immediately after the thermal transfer ribbon ink has been thermally transferred by the thermal head 12*b*, the ribbon is separated after the card C has been moved a predetermined position on the downstream side of the card conveying path, that is, after an ink from the ribbon has been fully set as a concealed cover on the card, it is possible to improve the printing quality.

Figure 17:
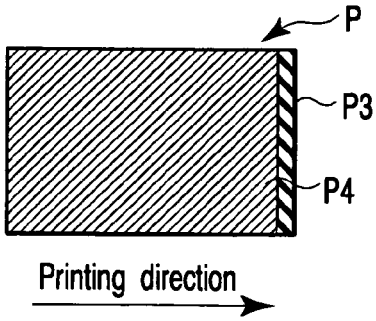
FIG. 17 is a view showing a final printing end edge portion of a printing area upon the making of solid printing in the second embodiment.

Although, in the above-mentioned embodiment, the printing energy at the outer marginal contour portion P1 of the solid printing area P is set to be greater than the printing energy at the remaining inside portion P2 of the solid printing area P, the present invention is not restricted thereto. Since, as set out above, it is only necessary to prevent any ill-defined printing edge from being left at a final end edge portion of any printing area P upon the making of any solid printing, any structure may be adopted in which, as set out above, the printing energy at least at the final printing end edge portion P3 of any printing area P of the card C is set to be greater than the printing energy at the remaining portion P4 of the printing area P upon the making of solid as shown in FIG. 17.

The present invention is not restricted to the above-mentioned embodiments as they are and their constituent elements are variously embodied without departing from the essence of the present invention. The present invention can be charged or modified by variously combining together a plurality of constituent parts disclosed in the above-mentioned embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A scratch card printer comprising:

a conveying section which conveys a card;

a first printing mechanism which has a thermal head;

a printing control section which controls the thermal head of the first printing mechanism, causing the thermal head to perform thermal printing to print information on the card;

a second printing mechanism which is located downstream of the first printing mechanism, in a direction of conveying the card by the conveying means, and which has a thermal head having less printing energy than the thermal head of the first printing mechanism;

a thermal transfer control section which controls the thermal head of the second printing mechanism, causing the thermal head to transfer ink from a thermal transfer ribbon to the card, thereby to conceal the information printed on the card by the first printing mechanism a temperature detecting section which detects ambient temperature; and a storage section which stores the printing energy levels of the printing head and thermal head relative to the ambient temperature, wherein the printing control section finds, from the storage section, the printing energy of the printing head corresponding to the ambient temperature detected by the temperature detecting section and control the printing energy of the printing head, and the thermal transfer control section finds, from the storage section, the printing energy of the thermal head corresponding to the ambient temperature detected by the temperature detecting section and control the printing energy of the printing head.

2. The scratch card printer according to claim 1, wherein the card has a heat-sensitive sheet base material and a heat-sensitive sheet color-developing layer formed on the heat sensitive sheet base material.

3. The scratch card printer according to claim 1, further comprising:

a sheet supply device which holds cards; and a delivery outlet which delivers the cards.

4. The scratch card printer according to claim 1, wherein the conveying section comprises a plurality of rollers.

5. The scratch card printer according to claim 4, wherein one of the rollers of the conveying section is arranged almost at midpoint between the thermal heads.

* * * * *